US006175987B1

(12) United States Patent
Harvey

(10) Patent No.: US 6,175,987 B1
(45) Date of Patent: Jan. 23, 2001

(54) PAINT BRUSH HOLDER

(76) Inventor: Russell Harvey, 29500 Heatherclif Rd., No. 236, Malibu, CA (US) 90265

( * ) Notice: Under 35 U.S.C. 154(b), the term of this patent shall be extended for 0 days.

(21) Appl. No.: 09/231,304

(22) Filed: Jan. 13, 1999

(51) Int. Cl.[7] ..... A46B 17/02; A46B 17/06

(52) U.S. Cl. ..... 15/257.01; 15/246; 15/268; 220/697

(58) Field of Search ..... 15/246, 257.01, 15/257.05, 264, 268; 211/65, 66; 220/695, 697, 700; 248/110, 111, 113, 213.2

(56) References Cited

U.S. PATENT DOCUMENTS

| | | | | |
|---|---|---|---|---|
| 286,405 | * | 10/1883 | Edwards . | |
| 731,289 | | 1/1903 | Domagola . | |
| 1,176,009 | * | 3/1916 | Weimar . | |
| 1,629,213 | * | 5/1927 | Hughes . | |
| 1,764,763 | * | 6/1930 | Stang | 220/697 |
| 2,278,650 | * | 4/1942 | Drinkwater . | |
| 2,566,804 | | 9/1951 | Flamme et al. . | |
| 2,715,478 | | 8/1955 | Andersen . | |
| 2,745,570 | | 5/1956 | Miller . | |
| 2,803,374 | | 8/1957 | Cash . | |
| 2,921,330 | * | 1/1960 | Prytikin | 15/257.05 |
| 3,156,364 | * | 11/1964 | Wolcott . | |
| 3,275,187 | | 9/1966 | Lamoureaux . | |
| 4,009,802 | * | 3/1977 | Hayduchok | 220/697 |
| 4,064,991 | * | 12/1977 | Swanson . | |
| 4,150,763 | | 4/1979 | Simpson . | |
| 4,266,686 | | 5/1981 | Carter . | |
| 4,491,234 | * | 1/1985 | Wilcock | 220/697 |
| 4,607,752 | * | 8/1986 | Sherrow . | |
| 4,632,347 | * | 12/1986 | Jurgich . | |
| 4,660,245 | * | 4/1987 | Anderson | 15/268 |
| 5,038,955 | * | 8/1991 | Studer et al. | 220/697 |
| 5,184,749 | * | 2/1993 | Attenasio | 15/257.01 |

* cited by examiner

*Primary Examiner*—Terrence R. Till
(74) *Attorney, Agent, or Firm*—Sheldon & Mak; Denton L. Anderson

(57) ABSTRACT

A paint brush holder is provided which conveniently retains paint brushes, especially during the wire brushing of the paint brushes. The paint brush holder comprises a tray having an upper surface and a lower surface. Disposed upon the upper surface is a plurality of slots, each having a low portion and a raised portion. Such slots can be used to conveniently retain paint brushes disposed upon their edges. The paint brush holder can further comprise a shaped recess having a wide portion and a narrow portion for conveniently retaining a paint brush disposed horizontally.

16 Claims, 2 Drawing Sheets

PAINT BRUSH HOLDER

FIELD OF THE INVENTION

This invention relates generally to painting equipment, and more specifically, to painting equipment for retaining paint brushes during cleaning.

BACKGROUND OF THE INVENTION

The use of paint brushes to apply paint is age-old The ability to use a particular paint brush repeatedly over time makes the use of paint brushes an economically attractive method of applying paint. The preservation of the ability to repeatedly re-use a paint brush, however, requires that all residual paint adhering to the paint brush is removed after every use. The removal of all such residual paint generally requires that the paint brush be scoured by repeated combing of the bristles with a wire brush.

Unfortunately, the wire brushing of a paint brush is an arduous job. It takes considerable strength to hold onto the handle of a paint brush during the wire brushing process. Thus, for professional painters who must clean a large number of paint brushes at the end of each day's work, the effort required to clean the brushes is considerable.

Accordingly, there is a need for a device for retaining paint brushes during the wire brush cleaning operation.

SUMMARY

The invention satisfies this need. The invention is a paint brush holder for retaining one or more paint brushes during the wire brushing process.

In one preferred embodiment, the paint brush holder has a plurality of slots for retaining paint brushes disposed on their edges. Each slot has a low portion and a raised portion so that the slot can firmly retain the paint brush during cleaning.

In another preferred embodiment, the paint brush holder comprises a shaped recess for retaining a horizontally-disposed paint brush.

The paint brush holder can be conveniently manufactured as a one-piece integral structure formed of a polymeric material, such as polypropylene.

DRAWINGS

These features, aspects and advantages of the present invention will become better understood with regard to the following description, appended claims and accompanying figures where:

DETAILED DESCRIPTION

Figure 1:
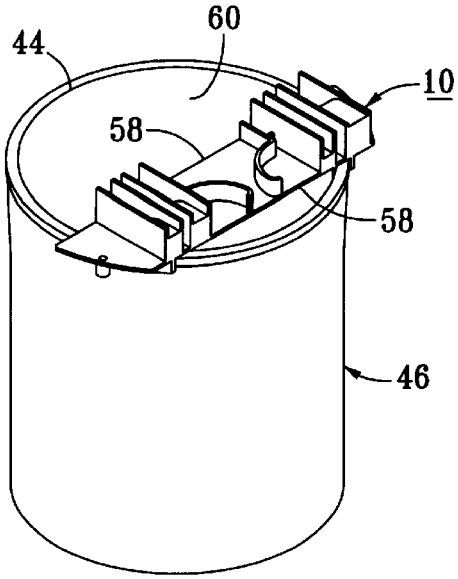
FIG. 1 is a perspective view of a paint brush holder having features of the invention shown mounted to the upper rim of an open container.
Figure 2:
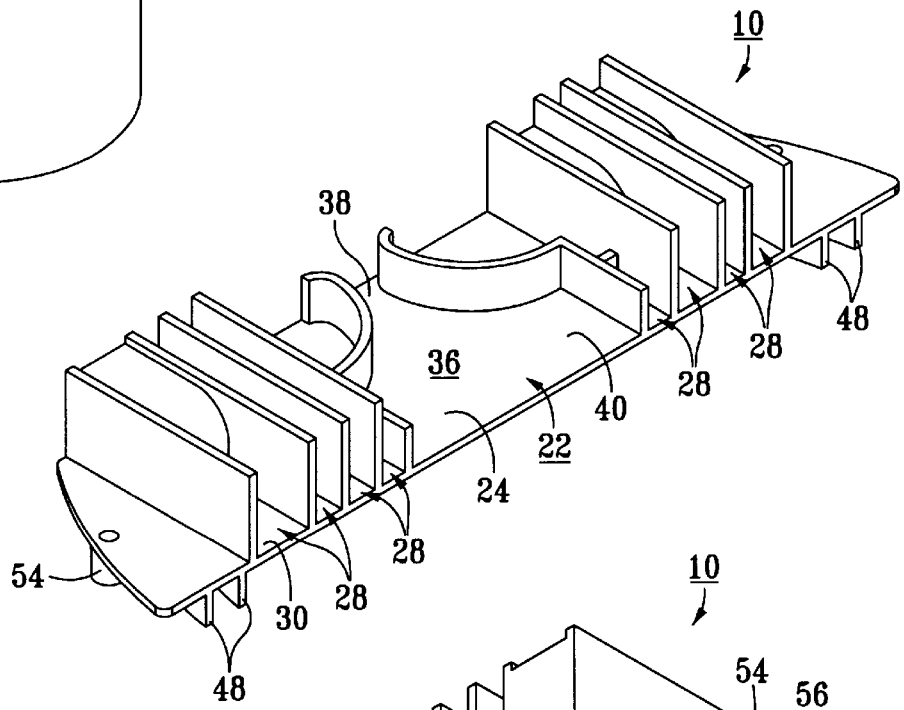
FIG. 2 is a second perspective view of the paint brush holder illustrated in FIG. 1.
Figure 3:
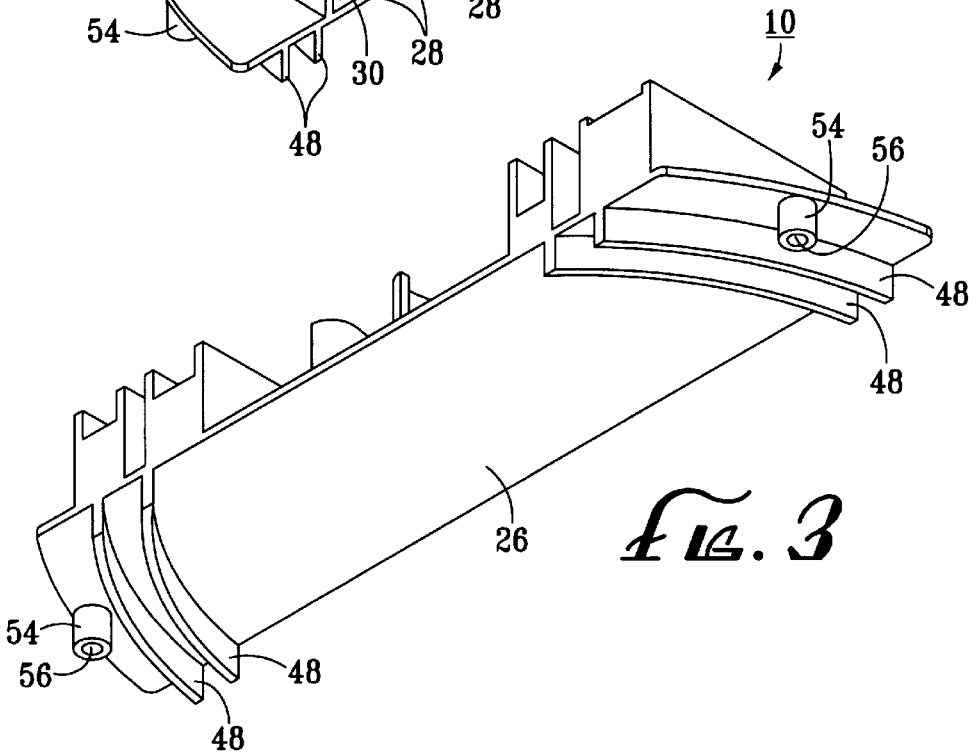
FIG. 3 is a third perspective view of the paint brush holder illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a paint brush holder 10 for retaining at least one paint brush 12 having a handle 14, a widened base 16 with opposed edges 18 and a plurality of bristles 20 disposed within the widened base 16.

The paint brush holder 10 comprises a tray 22 having an upper surface 24 and a lower surface 26. Preferably, the upper surface 24 has at least one slot 28 for retaining paint brushes 12 disposed (vertically) on an edge 18. Each such slot 28 has a width between about ½ inch and about 1 inch and a length of at least about 4 inches. Each such slot 28 also has a base 30 with a low portion 32 and a raised portion 34. The difference in elevation between the low portion 32 and the raised portion 34 facilitates the firm retention of a paint brush 12 within the slot 28 because the widened base 16 of the paint brush 12 can be firmly disposed in the low portion 32 of the slot 28 and the handle 14 of the paint brush 12 firmly disposed in the raised portion 34 of the slot 28.

In a still further preferred embodiment of the invention, the width of some or all of the slots 28 differs from the width of other slots 28. This facilitates the use of the paint brush holder 10 with paint brushes 12 having different edge widths. Also, it is preferable that at least one of the slots 28 has a difference in elevation between its low portion 32 and its raised portion 34 which is different than the difference in elevation between the low portion 32 and the raised portion 34 of another slot 28. This feature facilitates the retention of paint brushes 12 having different base widths.

Figure 7:
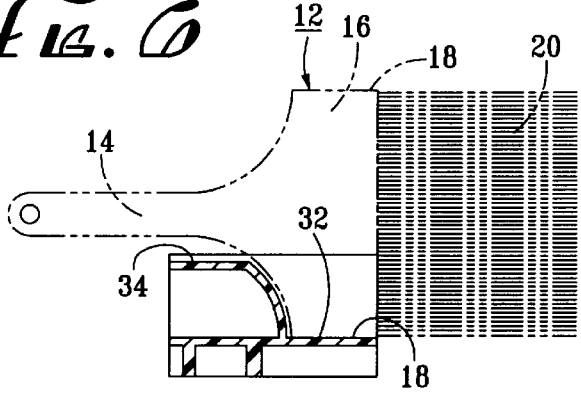
FIG. 7 is a cross-sectional side view of the paint brush holder illustrated in FIG. 4, taken along line 7—7.
Figure 8:
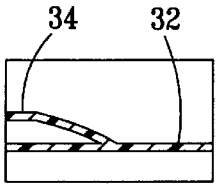
FIG. 8 is a cross-sectional side view of the paint brush holder illustrated in FIG. 4, taken along line 8—8.
Figure 9:
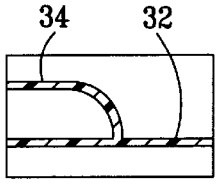
FIG. 9 is a cross-sectional side view of the paint brush holder illustrated in FIG. 4, taken along line 9—9.
Figure 10:
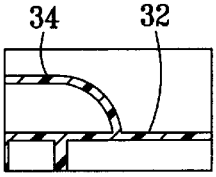
FIG. 10 is a cross-sectional side view of the paint brush holder illustrated in FIG. 4, taken along line 10—10.

As illustrated in FIGS. 7–9, the transition between the low portion 32 and the raised portion 34 of the slot 28 can be contoured to conform to the shape of contoured paint brushes 12 commonly on the market today. In one preferred embodiment, the contoured transition between the low portion 32 and the raised portion 34 can have a different shaped for each slot 28 (as illustrated in FIGS. 7–10) to accommodate paint brushes 12 having different contours.

Figure 4:
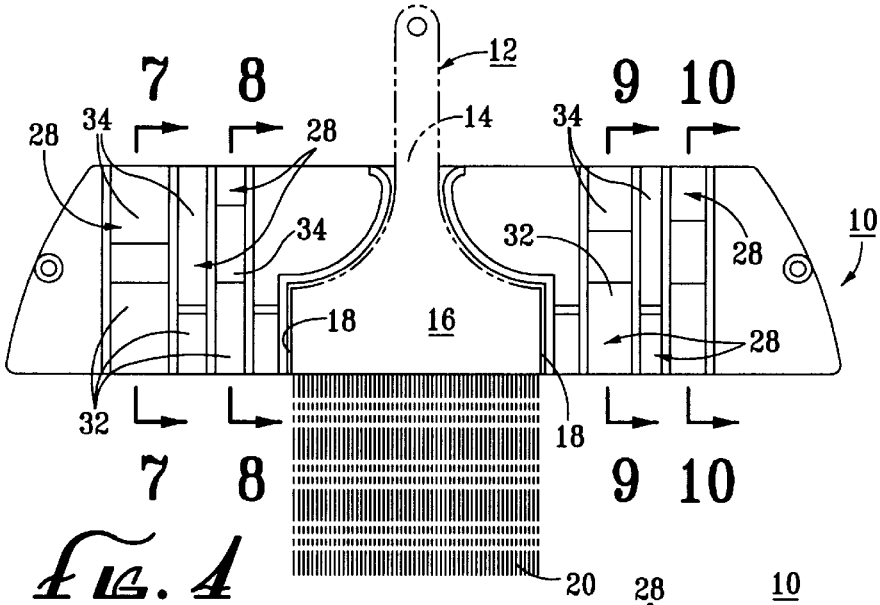
FIG. 4 is a top view of the paint brush holder illustrated in FIGS. 1–3.
Figure 5:
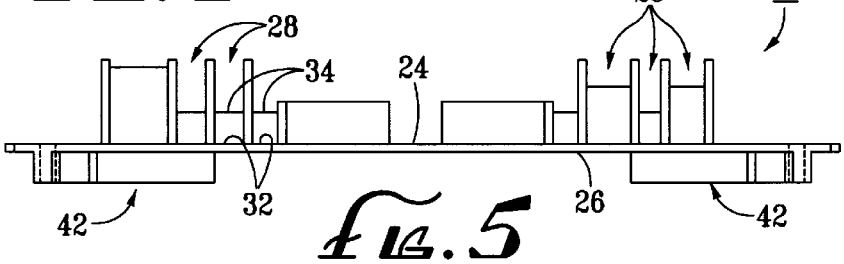
FIG. 5 is a side view of the paint brush holder illustrated in FIG. 4.

It is further preferable that the upper surface 24 of the tray 22 defines a shaped recess 36 for retaining a horizontally-disposed paint brush 12. Such shaped recess 36 has (i) a primary moiety 38 with a width between about ½ inch and about 2 inches and a depth between about ½ inch and about 1 inch and (ii) a secondary moiety 40 with a width between about 1 inch and about 4 inches and a depth between about 1 inch and about 4 inches. As illustrated in FIG. 4, the transition between the primary moiety 38 and the second moiety 40 of the shaped recess 36 can be contoured to match the contours of commonly marketed paint brushes 12.

Figure 6:
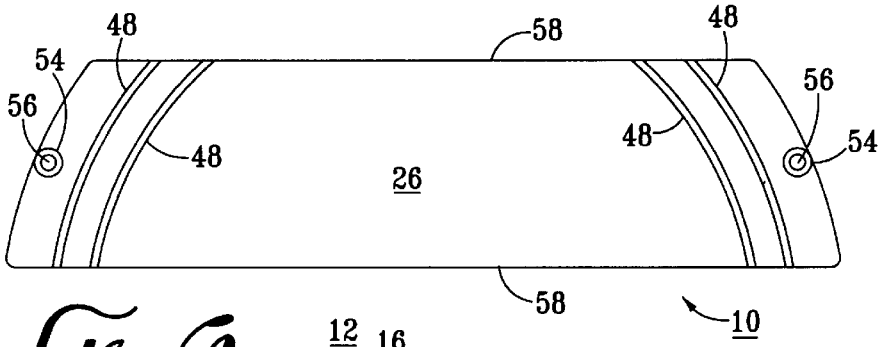
FIG. 6 is a bottom view of the paint brush holder illustrated in FIG. 4.

The lower surface 26 of the tray 22 preferably comprises at least one container retainer member 42 for facilitating the retention of the paint brush holder 10 atop the upper rim 44 of an open container 46, such as a five-gallon container frequently used by professional painters. In the embodiment illustrated in FIG. 6, such container retainer member 42 comprises a pair of opposed radial grooves 48 sized and dimensioned to retain the paint brush holder 10 to the upper rim 44 of a particularly sized open container 46.

The lower surface 26 of the tray 22 can further comprise one or more support members 50 for supporting the paint brush holder on a horizontal surface. In the embodiment illustrated in the drawings, such support members 50 are provided by the pair of opposed radial grooves 48 and a pair of legs 54. The lower edges of the radial grooves 48 and the legs 54 are disposed at the same elevation so that the paint brush holder 10 can be supported horizontally on a horizontal surface. Attachment apertures 56 disposed within each of the legs 54 facilitates the physical attachment of the paint brush holder 10 to the horizontal surface using screws or other equivalent elements.

As illustrated in the drawings, the tray 22 is typically elongate, having an opposed pair of substantially parallel long sides 58. Typically, the width between the two parallel long sides 58 is between about 1 inch and about 4 inches. It is also typical that the length of the tray 22 is between about 10 inches and about 14 inches. As illustrated in FIG. 1, when the tray 22 is placed upon the upper rim 44 of an open container 46, a paint brush opening 60 is defined between one of the two long sides 58 and the upper rim 44 of the open container 46.

The paint brush holder 10 of the invention can be conveniently manufactured as an integral, one-piece unit. Typically, the paint brush holder 10 is made from a polymeric material. One preferable polymeric material is polypropylene because of the efficiency with which it can be used to manufacture the paint brush holder, and because of polypropylene's inherent strength and chemical resistance characteristics.

In operation, the user of the paint brush holder 10 of the invention can retain a paint brush 12 on its edge 18 within one of the slots 28 (as illustrated in FIG. 7) and/or the user can retain a paint brush 12 within the shaped recess 36 (as illustrated in FIG. 4). In each such position, the user can conveniently wire brush the paint brush 12 by holding the paint brush 12 within the slot 28 or shaped recess 36 with his or her hand and combing the wire brush through the bristles 20 with his or her other hand.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A paint brush holder for retaining a plurality of paint brushes, each paint brush having bristles, the paint brush holder comprising a tray having an upper surface and a lower surface, the upper surface having at least one slot with a width between about 1 inch and about 4 inches and a length of at least about 4 inches, the at least one slot having a base with a lower portion and a raised portion, the upper surface also having a shaped recess with (i) a primary moiety with a width between about 1 inch and about 4 inches and a depth between about ½ inch and about 1 inch and (ii) a secondary moiety with a width between about ½ inch and about 4 inches and a depth between about ½ inch and about 1 inch such that the shaped recess is suitable for retaining a horizontally-disposed paint brush.

2. The paint brush holder of claim 1 further comprising at least one container retainer member disposed on the lower surface of the tray.

3. The paint brush holder of claim 2 wherein the at least one container retainer member is sized and dimensioned to retain the lower surface of the tray to an open five-gallon container.

4. The paint brush holder of claim 2 wherein the at least one container retainer member comprises at least one radial groove.

5. The paint brush holder of claim 1 wherein the tray is suitable for being removably mounted to the upper rim of an open container such that, when the tray is placed upon the upper rim of the container, a paint brush opening is defined between the tray and the upper rim of the open container, so that when a paint brush is retained within the at least one slot and when a paint brush is retained within the shaped recess, the bristles of the paint brush are disposed directly over the paint brush opening.

6. The paint brush holder of claim 1 wherein the lower surface of the tray further comprises at least one support member for supporting the paint brush holder on a horizontal surface.

7. The paint brush holder of claim 6 wherein the at least one support member comprises two or more legs.

8. The paint brush holder of claim 7 wherein at least two of the legs include an attachment aperture.

9. The paint brush holder of claim 1 wherein the upper surface has a plurality of slots, each with a width between about 1 inch and about 4 inches, a length of at least about 4 inches and a base with a low portion and a raised portion.

10. The paint brush holder of claim 9 wherein at least two of the slots have different widths.

11. The paint brush holder of claim 9 wherein the difference in elevation between the low portion and the raised portion of one of the slots is different from the difference in elevation between the low portion and the raised portion of another slot.

12. The paint brush holder of claim 1 wherein the tray is an integral, one-piece unit made from a polymeric material.

13. The paint brush holder of claim 1 wherein the tray is an integral, one-piece unit made from polypropylene.

14. The paint brush holder of claim 1 wherein the tray is elongate, having an opposed pair of substantially parallel long sides and wherein the width of the tray is between about 1 inch and about 5 inches and the length of the tray is between about 10 inches and about 14 inches.

15. A paint brush holder for retaining at least one paint brush, the paint brush holder comprising a tray having an upper surface and a lower surface, the upper surface having at least one slot with a width between about 1 inch and about 4 inches, a length of at least about 4 inches and a base with a low portion and a raised portion, wherein:

(a) the upper surface has a plurality of slots, each with a width between about ½ inches and about 4 inches, a length of least about 4 inches and a base with a low portion and a raised portion;

(b) at least two of the slots on the upper surface have different widths;

(c) the difference in elevation between the low portion and the raised portion of one of the slots is different from the difference in elevation between the low portion and the raised portion of another slot; and (d) the tray is an integral, one-piece unit made from a polymeric material.

16. The paint brush holder of claim 15 wherein the upper surface further comprises a shaped recess having (i) a primary moiety with a width between about 1 inch and about 4 inches and a depth between about ½ inch and about 1 inch and (ii) a secondary moiety with a width between about ½ inch and about 1 inch and about 4 inches and a depth between about 1 inch, so that the shaped recess is suitable for retaining a horizontally-disposed paint brush.

* * * * *